US011039666B2

(12) United States Patent
Ma

(10) Patent No.: US 11,039,666 B2
(45) Date of Patent: Jun. 22, 2021

(54) PLUG FOR BUCKLE, AND BUCKLE

(71) Applicant: YKK CORPORATION, Tokyo (JP)

(72) Inventor: Legong Ma, Kurobe (JP)

(73) Assignee: YKK Corporation

( * ) Notice: Subject to any disclaimer, the term of this patent is extended or adjusted under 35 U.S.C. 154(b) by 0 days.

(21) Appl. No.: 16/703,341

(22) Filed: Dec. 4, 2019

(65) Prior Publication Data

US 2020/0178652 A1 Jun. 11, 2020

(30) Foreign Application Priority Data

Dec. 7, 2018 (JP) ..... JP2018-229761

(51) Int. Cl.
*A44B 11/26* (2006.01)

(52) U.S. Cl.
CPC ..... *A44B 11/266* (2013.01)

(58) Field of Classification Search
CPC ..... A44B 11/266; A44B 11/2592; A44B 11/2519; Y10T 24/45581; Y10T 24/45524; Y10T 24/45529; Y10T 24/45534

See application file for complete search history.

(56) References Cited

U.S. PATENT DOCUMENTS

| | | | | |
|---|---|---|---|---|
| 7,559,123 | B1 * | 7/2009 | Yang | A44B 11/266 24/316 |
| 7,650,676 | B2 * | 1/2010 | Saitsu | A44B 11/2534 24/615 |
| 8,763,217 | B2 * | 7/2014 | Kaneko | A44B 11/266 24/615 |
| 2009/0178252 | A1 * | 7/2009 | Yang | A44B 11/266 24/625 |
| 2015/0143675 | A1 * | 5/2015 | Nanbu | A44B 11/266 24/697.1 |

FOREIGN PATENT DOCUMENTS

| | | |
|---|---|---|
| JP | 3207690 | 11/2016 |

* cited by examiner

*Primary Examiner* — Robert Sandy
(74) *Attorney, Agent, or Firm* — Taylor English Duma LLP

(57) ABSTRACT

A buckle includes a plug and a socket, the plug and the socket each being attached to a predetermined member and being capable of being connected to and disconnected from each other. The plug includes an attachment portion configured to be attached to the predetermined member and a pair of leg portions extending in the same direction from the attachment portion. An engagement portion is formed at each leg portion. Each leg portion is bent at a plurality of bending points between the attachment portion and the engagement portion in an extending direction of each leg portion. A U-shaped bridge is provided on inner side surfaces of the pair of leg portions, the inner side surfaces facing each other at vicinities of respective distal end portions of the pair of leg portions, the U-shaped bridge connecting vicinities of the respective distal end portions.

11 Claims, 5 Drawing Sheets

PLUG FOR BUCKLE, AND BUCKLE

CROSS-REFERENCE TO RELATED APPLICATIONS

This application is based on Japanese Patent Application (No. 2018-229761) filed on Dec. 7, 2018, the contents of which are incorporated herein by way of reference.

BACKGROUND

The present disclosure relates to a plug used for a buckle including the plug and a socket that detachably connect separate parts of a tape, a belt, and other members, and a buckle using the plug.

In a related art, for example, there is a buckle disclosed in Patent Document 1 as a buckle that detachably connects two objects to be connected. The buckle includes a plug and a socket, and the plug includes a pair of leg portions extending in one direction from both end portions in a width direction and locking portions protruding away from each other at distal end portions of the pair of leg portions. The socket includes a main body portion that houses the leg portion of the plug, and the main body portion is formed by an upper flat plate portion, a right side wall portion, a left side wall portion, and a lower flat plate portion. At rear end portions of the right wall portion and the left side wall portion, engaged portions are provided. The locking portions of the leg portions of the plug are locked to the engaged portions. And the locking portions of the plug abut on the engaged portions of the locking holes of the socket so as not to be drawn out.

Patent Document 1: Japanese Utility Model Registration No. 3207690

In the background art, when an impact is applied to the plug and the socket of the buckle in a pulling direction, a large force may be applied to a base of the leg portion of the plug, so that the leg portion may be damaged. When the leg portion is damaged, connection with the socket is inadvertently released, so that the buckle is disabled.

SUMMARY

At least one aspect of the present disclosure is to provide a plug which absorbs an impact applied to the buckle and prevents a leg portion of the plug from being damaged, and a buckle using the plug.

The present disclosure provides a plug for a buckle including the plug and a socket which are capable of being connected to and disconnected from each other and which are each attached to a predetermined member. The plug includes an attachment portion which is attached to the predetermined member; and a pair of leg portions which extend in the same direction from the attachment portion. An engagement portion is formed at the leg portion. The leg portion is bent at a plurality of bending points between the attachment portion and the engagement portion in an extending direction of the leg portion. Therefore, the leg portion has a meandering curve line shape, so that the leg portion has elasticity and can absorb an impact.

The leg portion is provided with the plurality of bending points in a meandering manner in a left-right direction in which the pair of the leg portions face each other. The pair of leg portions are bent in directions approaching each other or in directions separating from each other in the left-right direction until a first bending point, from a base end portion of the leg portion to the distal end portion.

Each of the leg portions is provided with two bending points, and the pair of leg portions are bent twice in the left-right direction and are formed in an S shape. Each of the leg portions may be provided with three or more bending points.

A total length of the leg portion when being straightened by stretching is approximately from 110% to 130% of a length from the attachment portion to the distal end portion. The leg portion is bent at the bending points with an absolute value from 10° to 15° with respect to the extending direction of the leg portion.

Further, the present disclosure also provides a buckle including the plug and a socket which is connectable to the plug.

DETAILED DESCRIPTION OF EXEMPLIFIED EMBODIMENTS

Figure 1:
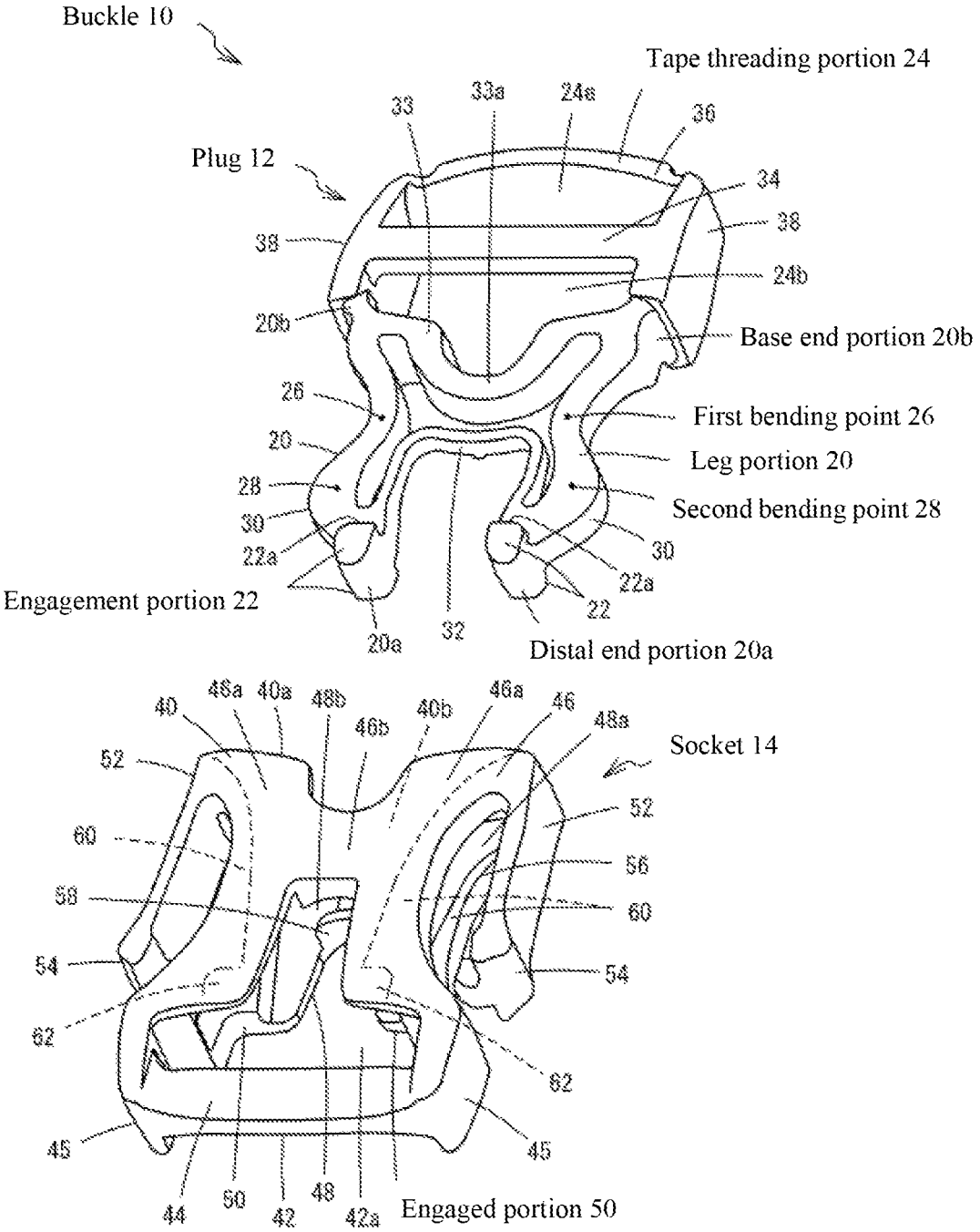
FIG. 1 is a perspective view illustrating a plug and a socket of a buckle that are not engaged with each other according to an embodiment of the present invention.

A buckle 10 according to an embodiment of the present invention will be described below with reference to FIGS. 1 to 4D. The buckle 10 includes a plug 12 and a socket 14 into which the plug 12 is fitted and engaged, and each of the plug 12 and the socket 14 is attached to a member such as a belt, a tape, or the like that is arbitrarily connected to and disconnected from each of the plug 12 and the socket 14. In the following description, an extending direction of a pair of leg portions 20, which will be described below, of the plug 12 is referred to as a lower direction, and a reverse direction of the lower direction is referred to as an upper direction. A direction which is orthogonal to an upper-lower direction and in which the pair of leg portions 20 face each other, is referred to as a left-right direction. A direction orthogonal to the left-right direction and the upper-lower direction is referred to as a front-back direction or a thickness direction.

The plug 12 is formed by integral molding with a synthetic resin which is polyacetal, polyamide, polypropylene, or the like. As illustrated in FIGS. 3A to 3D, the plug 12 includes a tape threading portion 24 which is an attachment portion to which a member such as a belt, a tape, or the like is attached, the pair of leg portions 20 which extend in the same direction from the tape threading portion 24 and which are inserted into the socket 14, and engagement portions 22 which are integrally provided at the leg portions 20. For example, the engagement portions 22 are provided at positions close to distal end portions 20*a* of the leg portions 20. In this case, a distance between the distal end portion 20*a* of the leg portion 20 and the engagement portion 22 is shorter than a distance between the tape threading portion 24 and the engagement portion 22. However, the engagement portions 22 may be provided at the other positions of the leg portions 20.

The pair of leg portions 20 extend with the same length in a mutually symmetrical shape, and extending directions from base end portions 20*b* continuous from the tape threading portion 24 toward the distal end portions 20*a* are parallel to each other. Each of the leg portions 20 is provided with first bending points 26 and second bending points 28 at predetermined intervals along the extending direction, and is formed in a curve meandering in an S shape. All of the predetermined intervals may be the same or different. The pair of leg portions 20 are first inclined with respect to the upper-lower direction so as to approach each other in a vicinity of the base end portions 20*b* continuous from the tape threading portion 24, as a distance from the tape threading portion 24 increases. The first bending points 26 are at positions slightly away from the base end portions 20*b*, and the pair of leg portions 20 are bent in directions away from each other in the left-right direction at the first bending points 26.

Figure 3A:
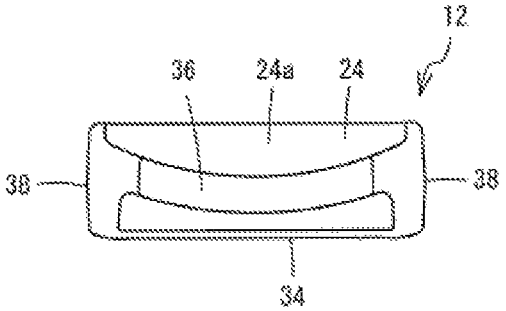
FIGS. 3A to 3D are a top view (3A), a front view (3B), a right side view (3C), and a bottom view (3D) of the plug of the buckle according to the embodiment.
Figure 3B:
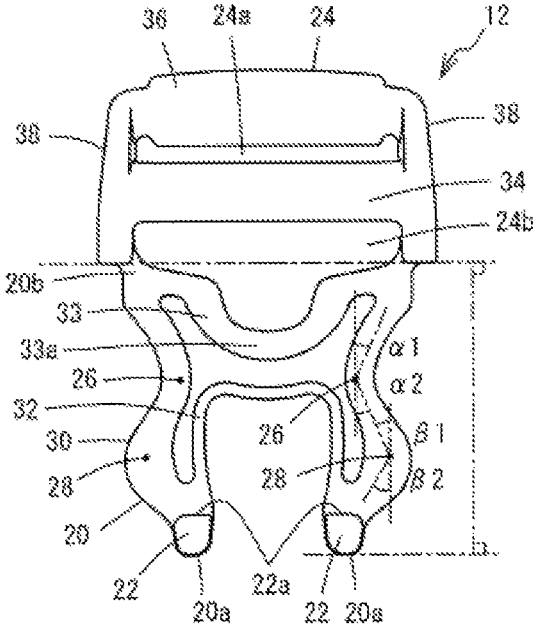
Figure 3C:
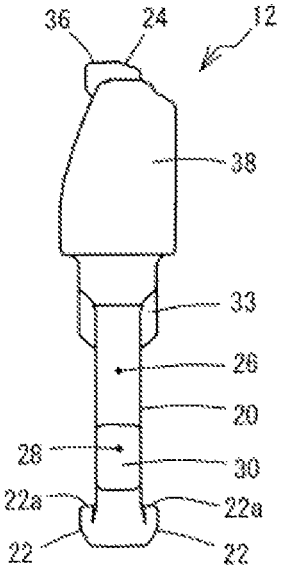
Figure 3D:
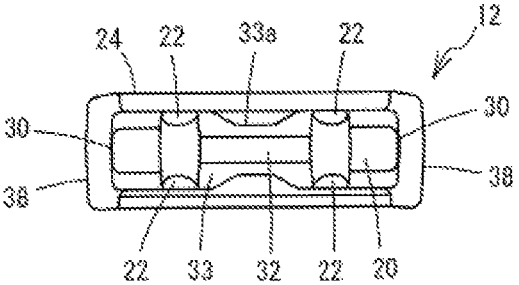
Figure 4A:
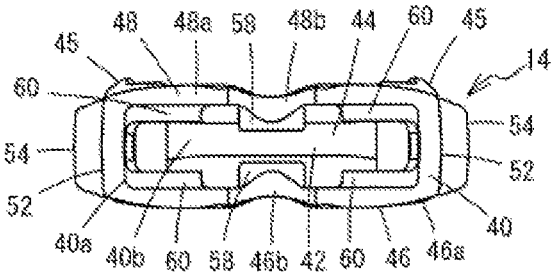
FIGS. 4A to 4D are a top view (4A), a front view (4B), a back side view (4C), and a bottom view (4D) of the socket of the buckle according to the embodiment.
Figure 4B:
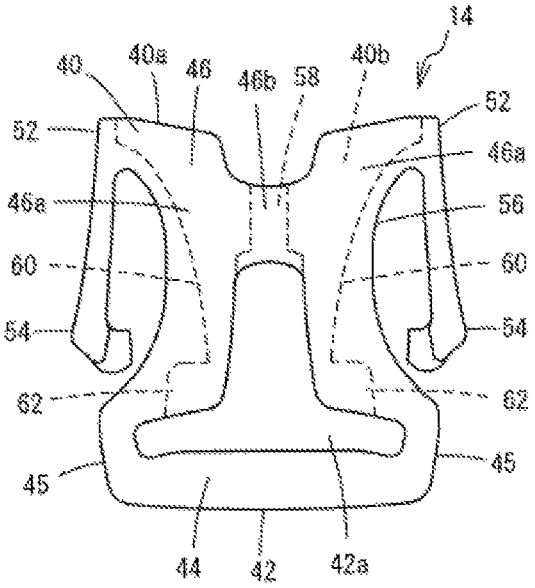
Figure 4C:
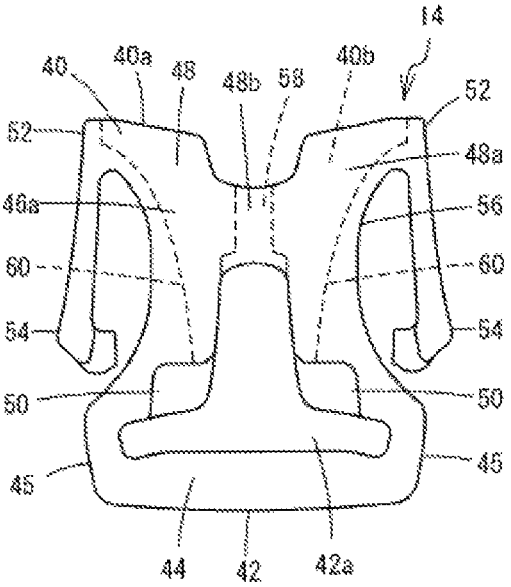
Figure 4D:
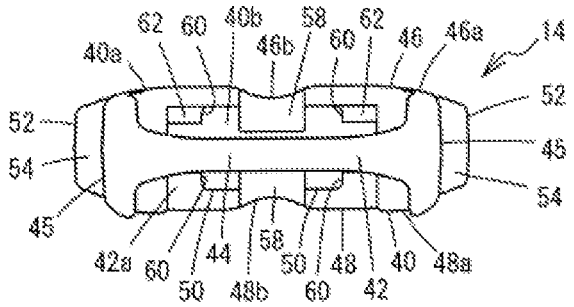

As illustrated in FIG. 3B, with respect to the upper-lower direction, an angle of the leg portion 20 in a vicinity of the first bending point 26 at a side of approaching the first bending point 26 is an angle $\alpha 1$, and an angle of the leg portion 20 in the vicinity of the first bending point 26 at a side of separating from the first bending point 26 is an angle $\alpha 2$. The second bending points 28 are between the first bending points 26 and the distal end portions 20*a*, and the pair of leg portions 20 are bent in directions approaching each other in the left-right direction at the second bending points 28. With respect to the upper-lower direction, an angle of the leg portion 20 in a vicinity of the second bending point 28 at a side of approaching the second bending point 28 is an angle (31, and an angle of the leg portion 20 in the vicinity of the second bending point 28 at a side of separating from the second bending point 28 is an angle $\beta 2$. Outer side surfaces of the pair of leg portions 20 that do not face each other between the first bending point 26 and the distal end portion 20*a* form operation portions 30 that swell outward. Here, the angle $\alpha 1$, the angle $\alpha 2$, the angle $\beta 1$, and the angle $\beta 2$ are arbitrary angles having an absolute value in a range from 10° to 15°. In other words, an angle of a line between the continuous bending points with respect to the extending direction of the leg portion 20 has an absolute value from 10° to 15°. All of the angles may be the same or different, or $\alpha 1$ and $\alpha 2$ or $\beta 1$ and $\beta 2$ may be the same while $\alpha$ and $\beta$ may be different. A total length of the leg portion 20 when being straightened by stretching is approximately from 110% to 130% of the length L from the tape threading portion 24 to the distal end portion 20*a* illustrated in FIG. 3B, for example, 120%.

The engagement portions 22 are provided so as to protrude in both front and back directions from the leg portions 20. For example, the engagement portions 22 are provided so as to protrude from the positions close to the distal end portions 20*a* of the leg portions 20. However, the engagement portions 22 may be provided so as to protrude from the other positions of the leg portions 20 The engagement portions 22 include locking step portions 22*a* each facing a base end portion 20*b* side of each of the leg portions 20. The locking step portions 22*a* are formed to be engageable with engaged portions 50 or housing recess portions 62, which will be described below, of the socket 14.

A U-shaped bridge 32 which connects vicinities of the distal end portions 20*a* is integrally provided on inner side surfaces of the pair of leg portions 20 that face each other near the distal end portions 20*a*. Both end portions of the bridge 32 are continuous from the inner side surfaces near the distal end portions 20*a*. A central part of the bridge 32 extends toward the base end portions 20*b*, and is curved in a U-shape near a lateral side of the first bending points 26 of the pair of leg portions 20.

A V-shaped bridge 33 which connects vicinities of the base end portions 20*b* of the pair of leg portions 20 is integrally provided on inner side surfaces of the pair of leg portions 20 that face each other near the base end portions 20*b*. The bridge 33 is formed slightly thicker than the bridge 32. Both end portions of the bridge 33 are continuous from inner side surfaces near the base end portions 20*b*. A central part of the bridge 33 extends toward a distal end portion 20*a* side, and is bent into a V shape at a position which does not reach the first bending points 26 of the pair of legs 20. A central part of the bridge 33 has a slight gap from the bridge 32.

In the tape threading portion 24, a first bar 34 and a second bar 36 are provided in parallel to each other in the left-right direction. The first bar 34 extends from both end portions thereof, and connects to the base end portions 20*b* of the leg portions 20. A second bar 36 is located on an opposite side of the leg portion 20 in the first bar 34. And both end portions of each of the first bar 34 and the second bar 36 are connected by side surface portions 38. A tape insertion hole 24*a* is formed between the first bar 34 and the second bar 36. A space is also formed in a part surrounded by the first bar 34 and the bridge 33 of the pair of leg portions 20 to form a tape insertion hole 24*b*.

A thickness of each portion of the plug 12 is formed such that the leg portion 20 is thinner than the side surface portion 38 of the tape threading portion 24, and a thickness of the vicinity of the base end portion 20*b* of the leg portion 20 is a thickness between the side surface portion 38 and the leg portion 20. The bridge 33 is formed with substantially the same thickness as the base end portion 20*b*, and a V-shaped distal end part of the bridge 33 is formed with slightly thin thickness and is a groove portion 33*a* into which a guide protrusion 58 of the socket 14 is fitted. The guide protrusion 58 will be described below. The engagement portions 22 protrude from the leg portions 20 to both sides in the front-back direction, and protruding surfaces are flat and are slightly thinner than the thicknesses of the base end portion 20*b* and the bridge 33. The bridge 32 is thinnest and thinner than the leg portions 20.

The socket 14 is also formed by integral molding with a synthetic resin which is polyacetal, polyamide, polypropylene, or the like. As illustrated in FIGS. 4A to 4D, the socket 14 includes a fitting portion 40 into which the leg portions 20 of the plug 12 are inserted, and a tape threading portion 42 to which a member such as a belt, a tape, or the like is attached. The tape threading portion 42 is formed with a tape insertion hole 42*a* through which a tape member or the like is inserted and a connection bar 44 which is configured to connect the tape member or the like. Both end portions of the connection bar 44 are connected to a pair of side surface portions 45 which are long in the upper-lower direction.

At an end portion of the side surface portion 45 located on an opposite side of the connection bar 44, a front surface portion 46 and a back surface portion 48 are provided and face each other with a predetermined interval therebetween to form the fitting portion 40 into which the plug 12 is inserted. The front surface portion 46 has a substantially H shape, and is formed by a pair of plate-shaped long plate portions 46*a* and a short horizontal plate portion 46*b*. The pair of plate-shaped long plate portions 46*a* are located in an extending direction of the side surface portion 45, and extend toward an opposite side of the tape threading portion 42. The short horizontal plate portion 46*b* intersects the long plate portion 46*a* at a substantially right angle. The horizontal plate portion 46*b* is provided at a position close to an end portion of the long plate portion 46*a* away from the tape threading portion 42. The back surface portion 48 has substantially the same H shape as the front surface portion 46, and is formed by a pair of plate-shaped long plate portions 48*a* and a short horizontal plate portion 48*b*. The pair of plate-shaped long plate portions 48*a* are located in the extending direction of the side surface portion 45 and extend toward the opposite side of the tape threading portion 42. The short horizontal plate portion 48*b* intersects the long plate portion 48*a* at a substantially right angle. The horizontal plate portion 48*b* is provided at a position close to an end portion of the long plate portion 48*a* away from the tape threading portion 42. The back surface portion 48 is provided with the engaged portions 50 by cutting corner portions of the pair of long plate portions 48*a* located on a tape insertion hole 42*a* side into a rectangular shape.

The front surface portion 46 and the back surface portion 48 face each other at a predetermined interval, and cantilever-shaped side surface portions 52 are provided at end portions on the opposite side of the tape threading portion 42. The cantilever-shaped side surface portions 52 connect end portions outside the long plate portions 46*a* of the front surface portion 46 and end portions outside the long plate portions 48*a* of the back surface portion 48. A pair of the side surface portions 52 are provided on left and right sides, and the fitting portion 40 is formed in a cylindrical shape, so that operation spaces are formed between the side surface portions 52 and the fitting portion 40. A housing space 40*b* into which the plug 12 is inserted, is formed between the front surface portion 46 and the back surface portion 48, and an opposite side of the tape threading portion 42 in the housing space 40*b* is an insertion opening 40*a* into which the plug 12 is inserted.

The side surface portions 52 are elongated plate bodies each extending from the insertion opening 40*a* to a vicinity of each of the side surface portions 45 of the tape threading portion 42. End portions of the side surface portions 52 on an insertion opening 40*a* side are connected to the front surface portion 46 and the back surface portion 48 and are a part of the insertion opening 40*a*. The end portions of the side surface portions 52 on an insertion opening 40*a* side serve as fixed ends. End portions near the side surface portions 45 on an opposite side of the end portions of the side surface portions 52 on the insertion opening 40*a* side are cantilevers which serve as free ends, and swing in the left-right direction. The swinging free ends serve as operation portions 54, which is configured to release engagement of the plug 12 engaged with the socket 14. An outer side surface of each of the operation portions 54 has a shape which extends slightly outward, so that the outer side surface of each of the operation portions 54 is easy to push from outside. A small protrusion on an inner side surface of each of the operation portions 54 protrudes toward the housing space 40*b* and is shaped such that the thin operation portion 30 of the engaged plug 12 is reliably pressed. The front surface portion 46 and the back surface portion 48 are formed such that only short parts of the end portions on the insertion opening 40*a* side is continuous from the side surface portion 52 to form the insertion opening 40*a* in a cylindrical shape, and space from the insertion opening 40*a* to the side surface portions 45 defines opened slits 56.

Outer side surfaces of the front surface portion 46 and the back surface portion 48, which do not face each other, are formed flat. On an inner side surface of the front surface portion 46, a pair of linear guide protrusions 58 and a pair of guide protrusions 60 are provided on the left and right sides. The pair of linear guide protrusions 58 run through the horizontal plate portion 46*b* in the upper-lower direction, and the pair of guide protrusions 60 are formed so as to be curved along the slits 56. The pair of guide protrusions 60 are located such that a width in the left-right direction decreases from the insertion opening 40*a* toward the tape insertion hole 42*a* of the tape threading portion 42. That is, both side walls of the pair of guide protrusions 60, which face each other, serve as guide surfaces which are configured to elastically deform the leg portions 20. Therefore the pair of leg portions 20 inserted into the insertion opening 40*a* are elastically deformed so as to approach each other along the guide protrusions 60 when an insertion amount increases. The guide protrusions 60 are formed continuously from the insertion opening 40*a* to the tape insertion hole 42*a*, and housing recess portions 62, in which the engagement portions 22 of the leg portions 20 are housed, are formed in a part continuous from the tape insertion hole 42*a*.

Each of the housing recess portions 62 is formed by cutting a guide surface of the protrusion 60 into a rectangular shape and includes inner wall facing the tape threading portion 42. Each of the inner walls faces the locking step portion 22*a* of the engagement portion 22 of the plug 12 so as not to be drawn out. The housing recess portions 62 are located at positions facing the engaged portions 50 and have substantially the same shape as the engaged portions 50.

On an inner side surface of the back surface portion 48, similarly to the front surface portion 46, the pair of linear guide protrusions 58 and the pair of guide protrusions 60 are provided on the left and right sides. The pair of linear guide protrusions 58 run through the horizontal plate portion 48*b* in the upper-lower direction. The pair of guide protrusions 60 are formed so to be curved along the slits 56. The pair of guide protrusions 60 are located such that the width in the left-right direction decreases from the insertion opening 40*a* toward the tape insertion hole 42*a* of the tape threading portion 42, and reach the engaged portions 50.

Next, engagement operation of the buckle 10 and a method of using the buckle 10 according to the embodiment will be described below. First, a method of attaching a tape member or the like to the plug 12 of the buckle 10 will be briefly described. The tape threading portion 24 of the plug 12 includes the first bar 34 and the second bar 36. A tape member (not illustrated) for connection is inserted into the tape insertion hole 24*b* from a back surface side of the plug 12. Then the tape member is inserted into a back surface side from a front surface side of the tape insertion hole 24*a* after passing through an outer periphery of the first bar 34. And the tape member is superposed on the tape member itself and pulled out so as to be adjustable in length. On the other hand, a tape member or the like (not illustrated) attached to the socket 14 is connected to the one connection bar 44 so as not to be adjustable.

Figure 2:
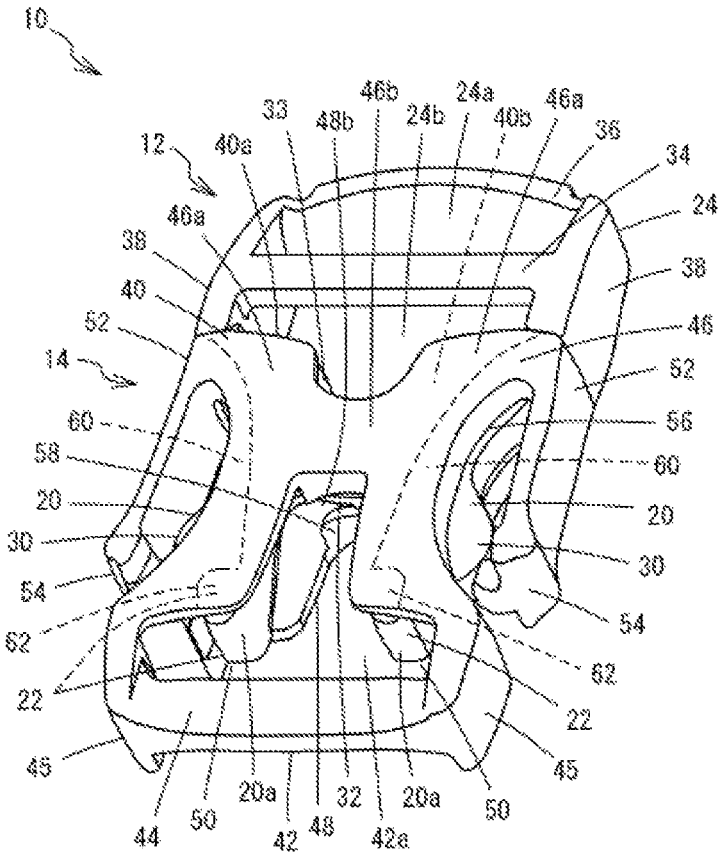
FIG. 2 is a perspective view illustrating the plug and the socket of the buckle that are connected with each other according to the embodiment.

In the engagement operation of the plug 12 and the socket 14, the leg portions 20 of the plug 12 is caused to face the insertion opening 40*a* of the socket 14, and the plug 12 is pushed into the socket 14. When the leg portions 20 are inserted into the housing space 40*b*, the leg portions 20 are surrounded by four guide protrusions 60 on upper, lower, left, and right sides. And the leg portions 20 are elastically deformed so as to approach each other since an interval between the guide protrusions 60 decreases as the plug 12 is inserted. When the engagement portions 22 of the leg portions 20 reach the housing recess portions 62 of the front surface portion 46 or the engaged portions 50 of the back surface portion 48, the elastic deformation is restored. And the engagement portions 22 are fitted into the housing recess portions 62 or the engaged portions 50. The locking step portions 22*a* of the engagement portions 22, which intersect and face a tape threading portion 24 side, abut against and engage with the inner walls of the engaged portions 50 or the housing recess portions 62, which intersect and face a tape threading portion 42 side, so as not to be drawn out. Accordingly, the plug 12 and the socket 14 are connected reliably to each other and engaged with each other as illustrated in FIG. 2. At this time, the bridge 33 of the plug 12 is fitted into the insertion opening 40*a* of the socket 14 and closes the insertion opening 40*a*. The guide protrusion 58 of the socket 14 is fitted into the groove portion 33*a* of the bridge 33 of the plug 12, so that the socket 14 and the plug 12 are not shifted from each other in the left-right direction. The operation portions 30 of the plug 12 protrude outward from the slits 56 of the socket 14, and the operation portions 54 of the socket 14 face the operation portions 30 with a slight gap therebetween.

Next, a case where an impact force is applied to the buckle 10 in the state where the plug 12 and the socket 14 are engaged with each other will be described. When an impact force is applied in a direction in which the plug 12 and the socket 14 of the buckle 10 are pulled apart, a strong pulling force is applied to the leg portions 20. However, the angles $\alpha$ and $\beta$ of lines between the continuous bending points with respect to the extending direction of the leg portion 20, are changed. And the leg portions 20 itself are elastically deformed such that the bending of the leg portions 20 extends, thereby the impact is absorbed. Accordingly, the leg portions 20 are prevented from being damaged.

In order to release the connection between the plug 12 and the socket 14, the pair of operation portions 54 are pressed from the outside to push the operation portions 30 of the plug 12. And the leg portions 20 of the plug 12 is elastically deformed to positions where the engagement portions 22 do not face the engaged portions 50 of the socket 14 or the inner walls of the housing recess portions 62. In this state, when the plug 12 and the socket 14 are slightly moved in directions away from each other, the engagement is easily released.

According to the buckle 10 in the embodiment, the leg portions 20 of the plug 12 are gently bent at the first bending point 26 and the second bending point 28 to be formed in the meandering curve. And the leg portions 20 are elastically deformed such that the bending extends when a shocking and strong tensile force is applied to the leg portions 20, thereby a damper effect like a spring is exerted so as to absorb the impact. Therefore, even if a shocking and strong tensile force is applied to the buckle 10 in the state where the plug 12 and the socket 14 are engaged with each other, the impact can be absorbed reliably, and the leg portions 20 of the plug 12 can be prevented from being damaged. The leg portions 20 of the plug 12 are not damaged and the connection of the plug 12 and the socket 14 are not inadvertently released, so that safety can be secured. The leg portions 20 are prevented from being unusable due to breakage, and durability is improved since the leg portions 20 are not easily damaged. The engagement portions 22 protrude from the leg portions 20 in the front-back direction and are locked to the front surface portion 46 and the back surface portion 48 of the socket 14. Therefore, a moment does not occur in the left-right direction when a pulling force is applied, the engagement portions 22 are stably locked, and an engagement force is high.

The first bending points 26 and the second bending points 28 are provided at a predetermined interval on the leg portions 20 in a longitudinal direction. Therefore, not only left and right elastic deformation but also elastic deformation in the upper-lower direction can be withstood. The leg portions 20 have appropriate elasticity. Therefore, releasing operation is easy and a release force is light. Meandering widths of the leg portions 20 are not excessively large, so that the elasticity is not excessively large and is appropriate, and the leg portions 20 have a high engagement force.

Figure 5A:
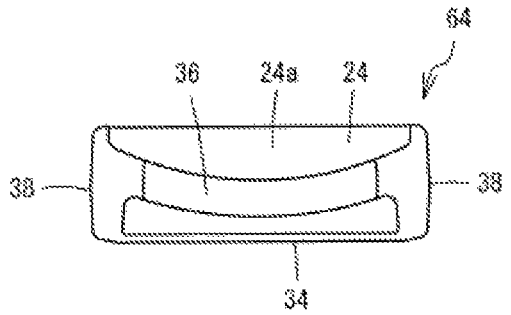
FIGS. 5A to 5D are a top view (5A), a front view (5B), a right side view (5C), and a bottom view (5D) illustrating a modification of the plug of the buckle according to the embodiment.
Figure 5B:
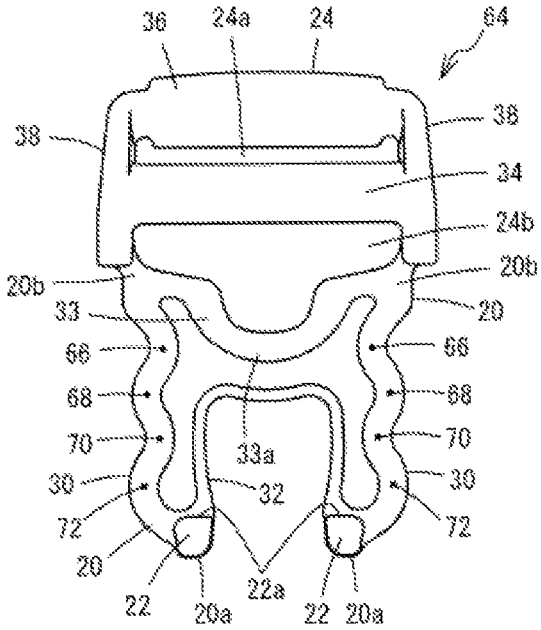
Figure 5C:
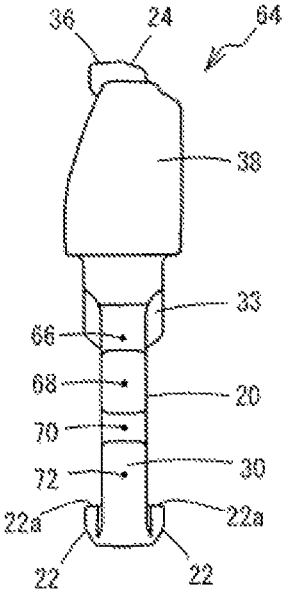
Figure 5D:
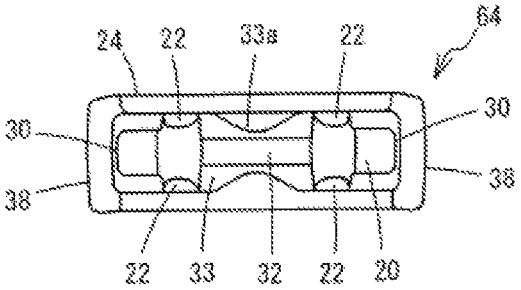

The plug for the buckle according to the present disclosure may be provided with three or more bending points. For example, in the leg portions 20 of a plug 64 illustrated in FIG. 5B, first bending points 66, second bending points 68, third bending points 70, and fourth bending points 72 are provided at predetermined intervals in order in a curve meandering in the left-right direction along the extending direction from the base end portions 20*b* toward the distal end portions 20*a*. The pair of leg portions 20 are first inclined with respect to the upper-lower direction so as to approach each other in the vicinity of the base end portions 20*b* continuous from the tape threading portion 24 as a distance from the tape threading portion 24 increases. The first bending points 66 are at positions slightly away from the base end portions 20*b*, and the pair of leg portions 20 are bent in directions away from each other in the left-right direction at the first bending points 66. The pair of leg portions 20 are bent in directions approaching each other in the left-right direction at the second bending points 28. The pair of leg portions 20 are bent again in the directions away from each other at the third bending points 70 and are bent again in the directions approaching each other at the fourth bending points 72. Angles of the leg portions 20 near each of the bending points are arbitrary angles having an absolute value in the range from 10° to 15° with respect to the upper-lower direction. All of the angles may be the same or different.

The leg portion 20 of the plug 64 is also formed in a curve which is gently bent and meandering, so that even if a shocking and strong force is applied to the buckle 10 in the state where the plug 64 and the socket 14 are engaged with each other, the impact can be absorbed reliably and the leg portions 20 of the plug 64 can be prevented from being damaged.

The buckle and the plug for the buckle according to the present invention are not limited to the above-described embodiments, and a shape of each member such as the engagement portion, the bridge, the tape threading portion or the like can be changed freely.

What is claimed is:

1. A plug for a buckle, the buckle including the plug and a socket, the plug and the socket each being attached to a predetermined member and being capable of being connected to and disconnected from each other, the plug comprising:

an attachment portion configured to be attached to one of the predetermined members; and a pair of leg portions extending in the same direction from the attachment portion, wherein an engagement portion is formed at each leg portion, and wherein each leg portion is bent at a plurality of bending points between the attachment portion and the engagement portion in an extending direction of each leg portion; and wherein a U-shaped bridge is provided on inner side surfaces of the pair of leg portions, the inner side surfaces facing each other at vicinities of respective distal end portions of the pair of leg portions, the U-shaped bridge connecting vicinities of the respective distal end portions.

2. The plug according to claim 1, wherein each leg portion is provided with the plurality of bending points in a meandering manner in a left-right direction in which the pair of the leg portions face each other.

3. The plug according to claim 1, wherein respective portions of the pair of leg portions are bent in directions approaching each other or in directions separating from each other in the left-right direction between the attachment portion of the plug and a first bending point of each leg portion.

4. The plug according to claim 1, wherein each of the leg portions is provided with two bending points, and the pair of leg portions are bent twice in the left-right direction and are formed in an S shape.

5. The plug according to claim 1, wherein a total length of each leg portion when being straightened by stretching is from 110% to 130% of a length from the attachment portion to the distal end portion of each leg portion.

6. The plug according to claim 1, wherein an angle of a line between the continuous bending points with respect to the extending direction of each leg portion has an absolute value from 10° to 15°.

7. A buckle comprising:

the plug according to claim 1; and a socket that is connectable to the plug.

8. The plug according to claim 1, wherein a distance between the distal end portion of each leg portion and the engagement portion is shorter than a distance between the attachment portion and the engagement portion.

9. The plug according to claim 1, wherein the plurality of bending points are provided at a predetermined interval.

10. The plug according to claim 1, wherein the plug defines a gap between the U-shaped bridge and a portion of the plug neighboring the U-shaped bridge, the gap extending between the pair of leg portions in a longitudinal direction of the plug.

11. A plug for a buckle, the buckle including the plug and a socket, the plug and the socket each being attached to a predetermined member and being capable of being connected to and disconnected from each other, the plug comprising:

an attachment portion configured to be attached to one of the predetermined members; and a pair of leg portions extending in the same direction from the attachment portion, wherein an engagement portion is formed at each leg portion, and wherein each leg portion is bent at a plurality of bending points between the attachment portion and the engagement portion in an extending direction of each leg portion; and wherein a total length of each leg portion when being straightened by stretching is from 110% to 130% of a length from the attachment portion to the distal end portion of each leg portion.

* * * * *